US006179295B1

(12) United States Patent
Lanza

(10) Patent No.: US 6,179,295 B1
(45) Date of Patent: Jan. 30, 2001

(54) FROG TARGET GAME

(76) Inventor: Carlos Lanza, 1233 Coronado Dr. #1, Sunnyvale, CA (US) 94086

( * ) Notice: Under 35 U.S.C. 154(b), the term of this patent shall be extended for 0 days.

(21) Appl. No.: 09/489,994

(22) Filed: Jan. 21, 2000

(51) Int. Cl.[7] ..... A63B 67/06

(52) U.S. Cl. ..... 273/402; 273/398; 273/400; 273/407; 273/394; 273/126 R; 273/123 R

(58) Field of Search ..... 273/440, 317, 273/348, 394, 398, 400, 401, 402, 407, 118 R, 118 A, 123 R, 123 A, 126 R, 126 A, 129 R, 129 B

(56) References Cited

U.S. PATENT DOCUMENTS

| | | | | |
|---|---|---|---|---|
| 768,397 | * | 8/1904 | Norton et al. | 273/394 X |
| 827,626 | * | 7/1906 | Gillet | 273/402 |
| 1,542,012 | * | 6/1925 | Spilman | 273/348 |
| 1,547,171 | * | 7/1925 | Huttlin | 273/407 |
| 3,550,942 | * | 12/1970 | Hawthorne | 273/119 R |
| 3,942,798 | * | 3/1976 | Koski | 273/394 |
| 5,320,360 | * | 6/1994 | St. Pierre | 273/402 |

* cited by examiner

*Primary Examiner*—Raleigh W. Chlu
(74) *Attorney, Agent, or Firm*—Goldstein & Canino

(57) ABSTRACT

A frog target game including a housing having a top wall, a bottom wall, an open front face, a rear wall, and opposed side walls. The top wall has a plurality of apertures therethrough in a spaced relationship. The plurality of apertures include a central aperture. The central aperture has a frog disposed thereover. The frog has an open mouth aligned with the central aperture. A plurality of chips are provided that are dimensioned for being received within the plurality of apertures of the top wall of the housing. A drawer is provided that is dimensioned for being received within the open front face of the housing. The drawer is comprised of a front wall, a back wall, opposed side walls, a bottom wall, and an open top. The bottom wall has a plurality of compartments formed therein corresponding with the plurality of apertures of the housing. Each of the compartments have an assigned point value. The plurality of compartments include a central compartment corresponding with the central aperture of the housing. The central aperture has a highest assigned point value.

8 Claims, 2 Drawing Sheets

FROG TARGET GAME

BACKGROUND OF THE INVENTION

The present invention relates to a frog target game and more particularly pertains to attempting to throw chips into a frog's mouth in order to score maximum points.

The use of games is known in the prior art. More specifically, games heretofore devised and utilized for the purpose of providing amusement are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,435,570 to Labrasseur discloses a game apparatus using a projectile shaped as an amphibian, such as a frog. U.S. Pat. No. Des. 86,836 to Gibbs, U.S. Pat. No. Des. 160,350 to Vunck, and U.S. Pat. No. Des. 333,492 to Paredes each disclose various ornamental designs for game devices.

While these devices fulfill their respective, particular objective and requirements, the aforementioned patents do not describe a frog target game for attempting to throw chips into a frog's mouth in order to score maximum points.

In this respect, the frog target game according to the present invention substantially departs from the conventional concepts and designs of the prior art, and in doing so provides an apparatus primarily developed for the purpose of attempting to throw chips into a frog's mouth in order to score maximum points.

Therefore, it can be appreciated that there exists a continuing need for a new and improved frog target game which can be used for attempting to throw chips into a frog's mouth in order to score maximum points. In this regard, the present invention substantially fulfills this need.

SUMMARY OF THE INVENTION

In the view of the foregoing disadvantages inherent in the known types of games now present in the prior art, the present invention provides an improved frog target game. As such, the general purpose of the present invention, which will be described subsequently in greater detail, is to provide a new and improved frog target game which has all the advantages of the prior art and none of the disadvantages.

To attain this, the present invention essentially comprises a housing having a generally rectangular configuration. The housing has a top wall, a bottom wall, an open front face, a rear wall, and opposed side walls. The rear wall extends above the top wall and has a curved upper portion with a cut-out formed therein. The opposed side walls each extend above the top wall. The housing includes a pair of wheels secured to the opposed side walls inwardly of the rear wall. The housing includes a support stand foldably secured to the bottom wall thereof. The top wall has a plurality of apertures therethrough in a spaced relationship. The plurality of apertures include a central aperture. The central aperture has a frog disposed thereover. The frog has an open mouth aligned with the central aperture. The top wall has a plurality of spinning wheels disposed therein inwardly of the open front face. A plurality of chips are provided that are dimensioned for being received within the plurality of apertures of the top wall of the housing. A drawer is provided that is dimensioned for being received within the open front face of the housing. The drawer is comprised of a front wall, a back wall, opposed side walls, a bottom wall, and an open top.

The front wall has a handle secured thereto. The bottom wall has a plurality of compartments formed therein corresponding with the plurality of apertures of the housing. Each of the compartments have an assigned point value. The plurality of compartments include a central compartment corresponding with the central aperture of the housing. The central compartment has a highest assigned point value.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved frog target game which has all the advantages of the prior art games and none of the disadvantages.

It is another object of the present invention to provide a new and improved frog target game which may be easily and efficiently manufactured and marketed.

It is a further object of the present invention to provide a new and improved frog target game which is of durable and reliable construction.

An even further object of the present invention is to provide a new and improved frog target game which is susceptible of a low cost of manufacture with regard to both materials and labor, and which accordingly is then susceptible of low prices of sale to the consuming public, thereby making such a frog target game economically available to the buying public.

Even still another object of the present invention is to provide a new and improved frog target game for attempting to throw chips into a frog's mouth in order to score maximum points.

Lastly, it is an object of the present invention to provide a new and improved frog target game including a housing having a top wall, a bottom wall, an open front face, a rear wall, and opposed side walls. The top wall has a plurality of apertures therethrough in a spaced relationship. The plurality of apertures include a central aperture. The central aperture has a frog disposed thereover. The frog has an open mouth aligned with the central aperture. A plurality of chips are provided that are dimensioned for being received within the plurality of apertures of the top wall of the housing. A drawer is provided that is dimensioned for being received within the open front face of the housing. The drawer is comprised of a front wall, a back wall, opposed side walls, a bottom wall, and an open top. The bottom wall has a plurality of compartments formed therein corresponding with the plurality of apertures of the housing. Each of the compartments have an assigned point value. The plurality of compartments include a central compartment corresponding with the central aperture of the housing. The central compartment has a highest assigned point value.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
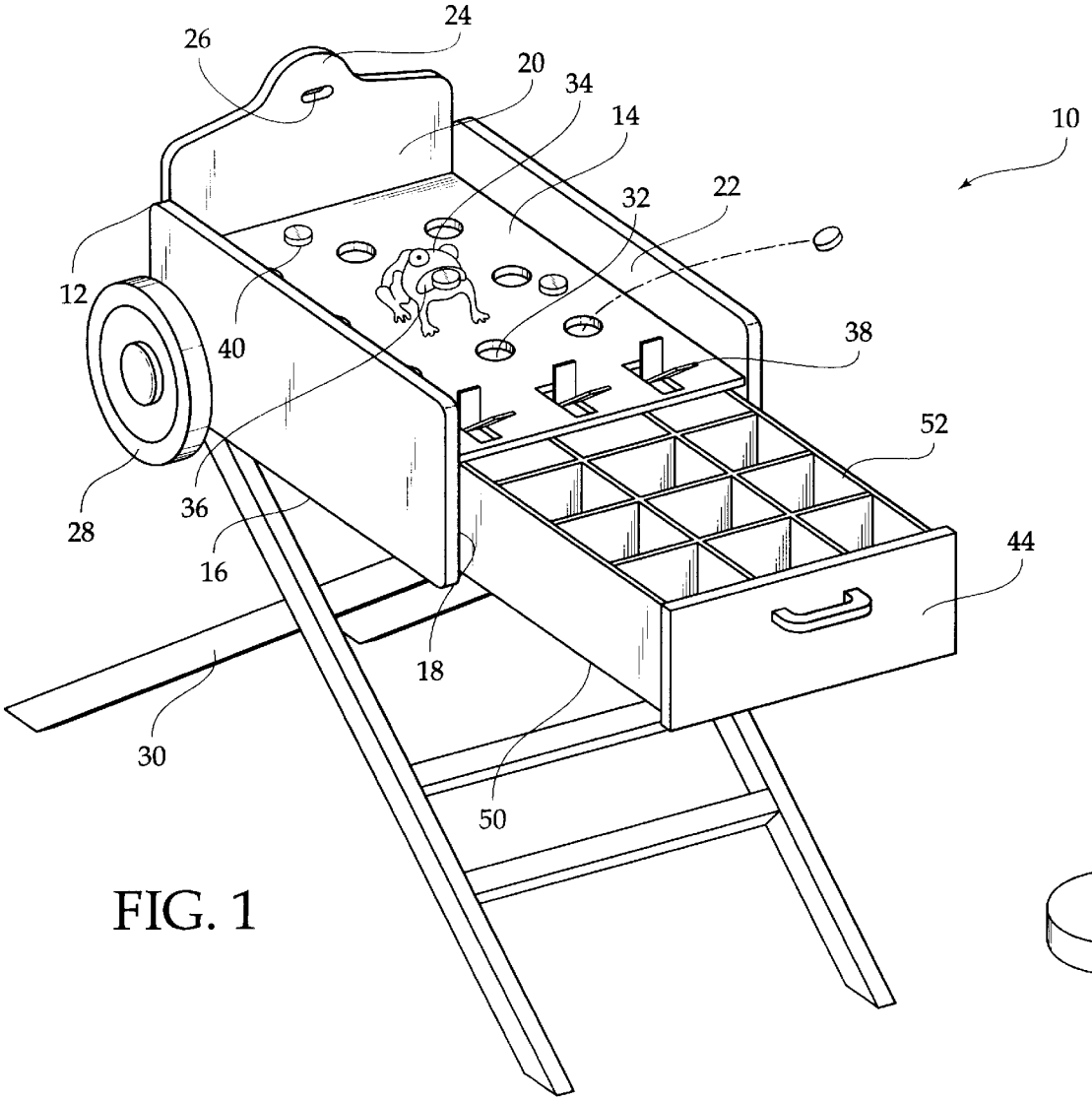
FIG. 1 is a perspective view of the preferred embodiment of the frog target game constructed in accordance with the principles of the present invention.
Figure 2:
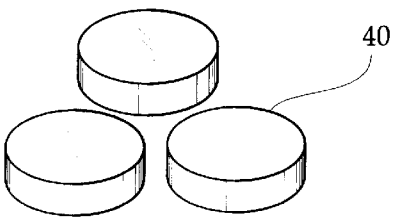
FIG. 2 is a perspective view of the chips of the present invention.
Figure 3:
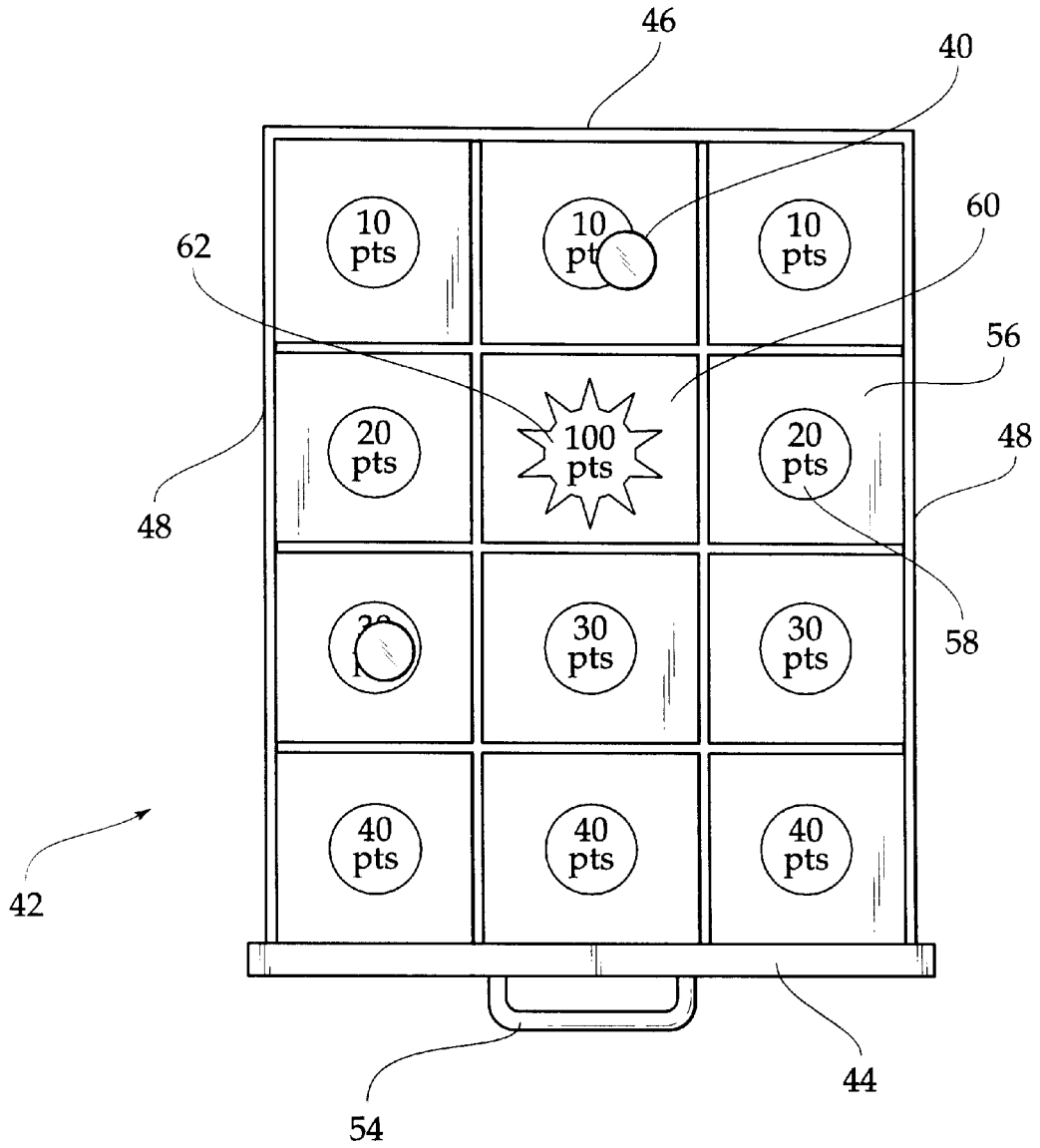
FIG. 3 is a plan view of the drawer of the present invention.

With reference now to the drawings, and in particular, to FIGS. 1 through 3 thereof, the preferred embodiment of the new and improved frog target game embodying the principles and concepts of the present invention and generally designated by the reference number 10 will be described.

Specifically, it will be noted in the various Figures that the device relates to a frog target game for attempting to throw chips into a frog's mouth in order to score maximum points. In its broadest context, the device consists of a housing, a plurality of chips, and a drawer. Such components are individually configured and correlated with respect to each other so as to attain the desired objective.

The housing 12 has a generally rectangular configuration. The housing 12 has a top wall 14, a bottom wall 16, an open front face 18, a rear wall 20, and opposed side walls 22. The rear wall 20 extends above the top wall 14 and has a curved upper portion 24 with a cut-out 26 formed therein. The cut-out 26 can receive fingers therethrough for use when transporting the housing 12. The opposed side walls 22 each extend above the top wall 14. The rear wall 20 and the opposed side walls 22 form an enclosure fort use when the chips (described in greater detail hereinafter) are thrown. The housing 12 includes a pair of wheels 28 secured to the opposed side walls 22 level with the rear wall 20. The housing 12 includes a support stand 30 foldably secured to the bottom wall 20 thereof. The top wall 14 has a plurality of apertures 32 therethrough in a spaced relationship. The plurality of apertures 32 include a central aperture. The central aperture has a frog 34 disposed thereover. The frog 34 has an open mouth 36 aligned with the central aperture. The top wall 14 has a plurality of spinning wheels 38 disposed therein inwardly of the open front face 18. The spinning wheels 38 will act as obstacles for the chips when thrown. The housing 12 is preferably constructed using an aluminum laminate over wood or particle board. The support stand 30 can be folded against the bottom wall 16 and used as a handle while transporting the housing 12 using the wheels 28. Note FIG. 1.

The plurality of chips 40 are dimensioned for being received within the plurality of apertures 32 of the top wall 14 of the housing 12. Note FIG. 2. The chips 40, preferably constructed of brass, are thrown from a distance at the top wall 14 of the housing 12 in attempt to enter into the frog's mouth 36. Those chips 40 that miss the frog's mouth 36 will hopefully fall through one of the plurality of apertures 32.

The drawer 42 is dimensioned for being received within the open front face 18 of the housing 12. The drawer 42 is comprised of a front wall 44, a back wall 46, opposed side walls 48, a bottom wall 50, and an open top 52. The front wall 44 has a handle 54 secured thereto. The bottom wall 50 has a plurality of compartments 56 formed therein corresponding with the plurality of apertures 32 of the housing 12. Each of the compartments 56 have an assigned point value 58. The plurality of compartments 56 include a central compartment 60 corresponding with the central aperture of the housing 12. The central compartment 60 has a highest assigned point value 62. Note FIG. 3. Once the chips 40 fall through the apertures 32, they will gather within the compartments 56. After all of the chips 40 have been thrown, the drawer 42 is removed from the housing 12, and the point values 58,62 are totaled. A player who has the highest point total is the winner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A frog target game for attempting to throw chips into a frog's mouth in order to score maximum points comprising, in combination:

a housing having a generally rectangular configuration, the housing having a top wall, a bottom wall, an open front face, a rear wall, and opposed side walls, the rear wall extending above the top wall and having a curved upper portion with a cut-out formed therein, the opposed side walls each extending above the top wall, the housing including a pair of wheels secured to the opposed side walls inwardly of the rear wall, the housing including a support stand foldably secured to the bottom wall thereof, the top wall having a plurality of apertures therethrough in a spaced relationship, the plurality of apertures including a central aperture, the central aperture having a frog disposed thereover, the frog having an open mouth aligned with the central aperture, the top wall having a plurality of spinning wheels disposed therein inwardly of the open front face;

a plurality of chips dimensioned for being received within the plurality of apertures of the top wall of the housing;

a drawer dimensioned for being received within the open front face of the housing, the drawer being comprised of a front wall, a back wall, opposed side walls, a bottom wall, and an open top, the front wall having a handle secured thereto, the bottom wall having a plurality of compartments formed therein corresponding with the plurality of apertures of the housing, each of the compartments having an assigned point value, the plurality of compartments including a central compartment corresponding with the central aperture of the housing, the central compartment having a highest assigned point value.

2. A frog target game for attempting to throw chips into a frog's mouth in order to score maximum points comprising, in combination:

a housing having a top wall, a bottom wall, an open front face, a rear wall, and opposed side walls, the top wall having a plurality of apertures therethrough in a spaced relationship, the plurality of apertures including a central aperture, the central aperture having a frog disposed thereover, the frog having an open mouth aligned with the central aperture;

a plurality of chips dimensioned for being received within the plurality of apertures of the top wall of the housing;

a drawer dimensioned for being received within the open front face of the housing, the drawer being comprised of a front wall, a back wall, opposed side walls, a bottom wall, and an open top, the bottom wall having a plurality of compartments formed therein corresponding with the plurality of apertures of the housing, each of the compartments having an assigned point value, the plurality of compartments including a central compartment corresponding with the central aperture of the housing, the central compartment having a highest assigned point value.

3. The frog target game as set forth in claim 2 wherein the rear wall of the housing extends above the top wall and has a curved upper portion with a cut-out formed therein.

4. The frog target game as set forth in claim 2 wherein the opposed side walls of the housing each extend above the top wall.

5. The frog target game as set forth in claim 2 wherein the housing includes a pair of wheels secured to the opposed side walls inwardly of the rear wall.

6. The frog target game as set forth in claim 2 wherein the housing includes a support stand foldably secured to the bottom wall thereof.

7. The frog target game as set forth in claim 2 wherein the top wall of the housing has a plurality of spinning wheels disposed therein inwardly of the open front face.

8. The frog target game as set forth in claim 2 wherein the front wall of the drawer has a handle secured thereto.

* * * * *